US012053067B1

(12) United States Patent
Hu

(10) Patent No.: US 12,053,067 B1
(45) Date of Patent: Aug. 6, 2024

(54) CARD HOLDER WALLET

(71) Applicant: Shenzhen Wanhui Technology Innovation Co., Ltd., Shenzhen (CN)

(72) Inventor: Xiafang Hu, Shenzhen (CN)

( * ) Notice: Subject to any disclaimer, the term of this patent is extended or adjusted under 35 U.S.C. 154(b) by 0 days.

(21) Appl. No.: 18/506,098

(22) Filed: Nov. 9, 2023

(30) Foreign Application Priority Data

Oct. 19, 2023 (CN) ..... 202322806624.X

(51) Int. Cl.
*A45C 1/06* (2006.01)

(52) U.S. Cl.
CPC ..... *A45C 1/06* (2013.01); *A45C 2001/065* (2013.01); *A45C 2001/067* (2013.01)

(58) Field of Classification Search
CPC ..... A45C 1/06; A45C 2001/06545
See application file for complete search history.

(56) References Cited

U.S. PATENT DOCUMENTS 7,918,335 B1 * 4/2011 Kitchen ..... A45C 11/18 150/132
9,907,375 B1 * 3/2018 Kitchen ..... A45C 1/06
10,793,342 B2 * 10/2020 Minson ..... B65D 83/0829
2018/0332936 A1 * 11/2018 Serman ..... A45C 11/182
2020/0178657 A1 * 6/2020 Van Geer ..... A45C 11/182
2021/0330045 A1 * 10/2021 Tran ..... A45C 1/06

FOREIGN PATENT DOCUMENTS

CH 717210 A2 * 9/2021 ..... A45C 11/182

* cited by examiner

*Primary Examiner* — Sue A Weaver

(57) ABSTRACT

The present disclosure also provides a card holder wallet. The card holder wallet includes a shell and a push device. The shell is provided with a first accommodating cavity and a first accommodating opening. The first accommodating cavity is encircled by a side wall of the shell. The first accommodating opening is communicated with the first accommodating cavity. The first accommodating cavity is configured to accommodate a card. The push device is connected to the shell. The push device is configured to push the card out of the first accommodating cavity via the first accommodating opening. Through the above structure, a user can easily push a card in the first accommodating cavity towards the first accommodating opening and out of the first accommodating cavity through the push device, making it easy for the user to accurately and quickly fetch a desired card.

18 Claims, 9 Drawing Sheets

CARD HOLDER WALLET

CROSS-REFERENCE TO RELATED APPLICATIONS

The application claims priority of Chinese patent application CN202322806624X, filed on 19 Oct. 2023, which is incorporated herein by reference in its entireties.

TECHNICAL FIELD

The present disclosure relates to the field of card holder wallets, and particularly, to a card holder wallet.

BACKGROUND

In modern life, people have to use various cards to some extent, such as various IC cards, bank cards, supermarket cards, shopping cards, and membership cards. Such a large number of cards are difficult to store and are easily confused. This often brings many unnecessary troubles. A card holder wallet is precisely designed to manage such a large number of cards, and can be referred to as a product of modern economy. A traditional card holder wallet on the market are usually provided with an accommodating cavity and an accommodating opening. A card is placed into the accommodating cavity through the accommodating opening, and then the accommodating opening is closed through a cover. However, there are following problems: When a user needs to take out a card, the user has to put fingers into the accommodating cavity to take out the card from the accommodating cavity, which is time-consuming and labor-intensive, making it difficult for the user to take out and place cards.

SUMMARY

In order to overcome the shortcomings of the prior art, the present disclosure provides a card holder wallet, including:

a shell, wherein the shell is provided with a first accommodating cavity and a first accommodating opening; the first accommodating cavity is encircled by a side wall of the shell; the first accommodating opening is communicated with the first accommodating cavity; the first accommodating cavity is configured to accommodate a card; and a push device, wherein the push device is connected to the shell; and the push device is configured to push the card out of the first accommodating cavity via the first accommodating opening.

As the improvement of the present disclosure, the push device includes a button, a push wheel, a push rod, a push plate, and an elastic reset member; the shell is provided with a first rotating shaft and a second rotating shaft; the first rotating shaft is arranged at a bottom of the first accommodating cavity; the push plate has a first end and a second end; a first mounting port exists between the first end and the second end; the first mounting port of the push plate sleeves the first rotating shaft; the push wheel is provided with a second mounting port; the second mounting port of the push wheel sleeves the second rotating shaft; a push member is arranged between the push wheel and the push plate; when the button is pressed, the button drives the push wheel to rotate, and the push wheel rotates to push the push rod towards a direction facing away from the first accommodating opening, so that the push rod pushes the first end of the push plate towards the direction facing away from the first accommodating opening and pushes the second end towards the first accommodating opening; the second end pushes the card towards the first accommodating opening and out of the first accommodating cavity; one end of the elastic reset member is connected to the button, and the other end of the elastic reset member is connected to the shell; when the button is pressed, the elastic reset member is compressed; and an elastic reset force provided when the elastic reset member is compressed pushes the button to be reset.

As the improvement of the present disclosure, the button is provided with a rack; the push wheel is provided with a gear and a pressing convex block; the gear is engaged with the rack; and when the button is pressed, the rack of the button slides to drive the gear of the push wheel to rotate, and the pressing convex block rotates with the gear to push the push rod in the direction facing away from the first accommodating opening.

As the improvement of the present disclosure, the button is provided with a first mounting slot; the shell is provided with a second mounting slot; and one end of the elastic reset member is located in the second mounting slot, and the other end of the elastic reset member is located in the first mounting slot.

As the improvement of the present disclosure, the button is further provided with a third mounting slot; the rack is arranged on an inner wall of the third mounting slot; and the gear is located inside the third mounting slot.

As the improvement of the present disclosure, the card holder wallet further includes a flexible protective sleeve, wherein the protective sleeve is provided with a first portion and a second portion; the second portion and the first portion are rotatable; the first portion is connected to a bottom surface of the shell; and the second portion rotates to cover a top surface of the shell.

As the improvement of the present disclosure, the first portion includes a first sheet body and a second sheet body; an inner side of the first sheet body covers the bottom surface of the shell; the second sheet body is connected to an outer side of the first sheet body; a second accommodating cavity is formed between an inner side of the second sheet body and the outer side of the first sheet body; and an upper side of the second accommodating cavity is provided with a second accommodating opening.

As the improvement of the present disclosure, the first portion includes a third sheet body; the third sheet body is connected to the second sheet body; an inner side of the third sheet body covers an outer side of the second sheet body; a third accommodating cavity is formed between the inner side of the third sheet body and the outer side of the second sheet body; an upper side of the third accommodating cavity is provided with a third accommodating opening; both the second accommodating opening and the third accommodating opening are trapezoid accommodating openings; and the second accommodating opening and the third accommodating opening are arranged in sequence from top to bottom.

As the improvement of the present disclosure, the second portion includes a fourth sheet body and a fifth sheet body; the fourth sheet body is connected to the first sheet body; the fifth sheet body is connected to an outer side of the fourth sheet body; an inner side of the fifth sheet body covers the outer side of the fourth sheet body; a fourth accommodating cavity is formed between the inner side of the fifth sheet body and the outer side of the fourth sheet body; an upper side of the fourth accommodating cavity is provided with a fourth accommodating opening; and a lower side of the fourth accommodating cavity is provided with a first notch.

As the improvement of the present disclosure, the second portion further includes a sixth sheet body; the sixth sheet body is connected to the inner side of the fourth sheet body; an inner side of the sixth sheet body covers the inner side of the fourth sheet body; a fifth accommodating cavity is formed between the inner side of the sixth sheet body and the inner side of the fourth sheet body; the fifth accommodating cavity is provided with a fifth accommodating opening; the sixth sheet body is provided with a transparent window; the transparent window is provided with a second notch; and the second notch is communicated with the fifth accommodating cavity.

As the improvement of the present disclosure, the shell further includes a first side wall opposite to the first accommodating opening, a second side wall, a third side wall opposite to the second side wall, a fourth side wall, and a fifth side wall opposite to the fourth side wall; the first accommodating cavity is encircled by the first side wall, the second side wall, the third side wall, the fourth side wall, and the fifth side wall; the card holder wallet further includes an elastic member; the elastic member is arranged in the first accommodating cavity; the elastic member is configured to press and lock the card in the first accommodating cavity; the elastic member is arranged on an inner surface of the second side wall; and the elastic member is configured to press and lock the card to the third side wall.

As the improvement of the present disclosure, the first portion is connected to a bottom surface of the fourth side wall; and the second portion rotates to cover a top surface of the fifth side wall.

As the improvement of the present disclosure, the shell is provided with a first sliding rail; and the button slides on the first sliding rail.

As the improvement of the present disclosure, the shell is further provided with a second sliding rail; and the button slides on the second sliding rail.

As the improvement of the present disclosure, a first sliding chute is arranged on an upper side of the button; a second sliding chute is arranged on a lower side of the button; the first sliding chute is connected to the first sliding rail; and the second sliding chute is connected to the second sliding rail.

As the improvement of the present disclosure, an inner wall of the first accommodating cavity is further provided with a locating piece, and the elastic member is provided with a locating port; and the locating port sleeves the locating piece.

As the improvement of the present disclosure, the elastic member is provided with several elastic bulges; the elastic bulges press and lock the card in the first accommodating cavity; the elastic member includes a first elastic member unit and a second elastic member unit; the locating piece includes a first locating piece unit arranged on an upper side of the inner wall of the first accommodating cavity and a second locating piece unit located on a lower side of the inner wall of the first accommodating cavity; the first elastic member unit and the second elastic member unit are independent of each other; the first elastic member unit sleeves the first locating piece unit; and the second elastic member unit sleeves the second locating piece unit.

As the improvement of the present disclosure, the second portion is provided with a magnetic suction member; the fifth side wall is a magnetic metal side wall; and when the second portion rotates to cover the top surface of the fifth side wall, the magnetic suction member sucks the second portion to the top surface of the fifth side wall.

As the improvement of the present disclosure, the card holder wallet further includes an elastic clamp; one end of the clamp is connected to the shell, and the other end of the clamp compresses the fifth side wall to form a clamping space between the clamp and the fifth side wall.

As the improvement of the present disclosure, the second end is provided with several steps, and heights of the steps increase gradually in sequence from the second end to the first end.

As the improvement of the present disclosure, the elastic member is a silica gel elastic member.

As the improvement of the present disclosure, a quantity of the several steps is at least 2.

As the improvement of the present disclosure, the button is arranged on the third side wall.

Beneficial effects of the present disclosure are as follows: The present disclosure also provides a card holder wallet. The card holder wallet includes a shell and a push device. The shell is provided with a first accommodating cavity and a first accommodating opening. The first accommodating cavity is encircled by a side wall of the shell. The first accommodating opening is communicated with the first accommodating cavity. The first accommodating cavity is configured to accommodate a card. The push device is connected to the shell. The push device is configured to push the card out of the first accommodating cavity via the first accommodating opening. Through the above structure, a user can easily push a card in the first accommodating cavity towards the first accommodating opening and out of the first accommodating cavity through the push device, making it easy for the user to accurately and quickly fetch a desired card.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
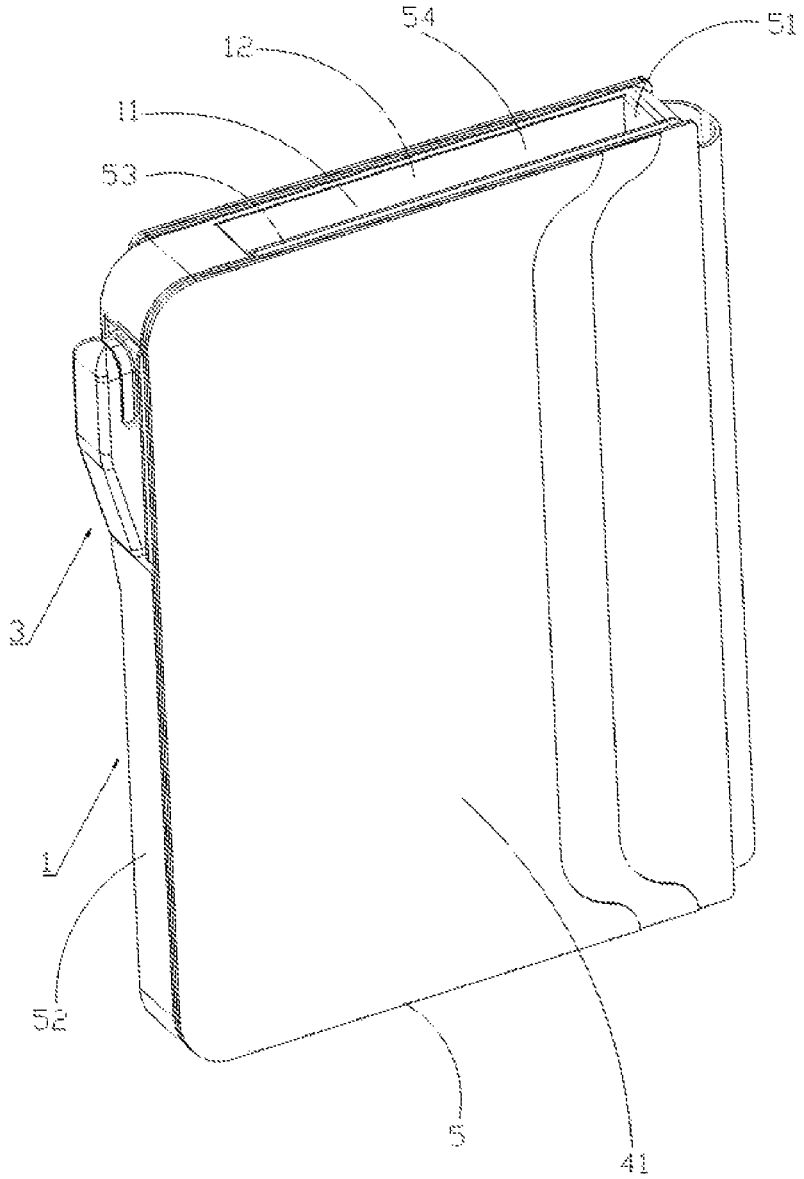
FIG. 1 is a schematic diagram of an entire structure of the present disclosure.
Figure 2:
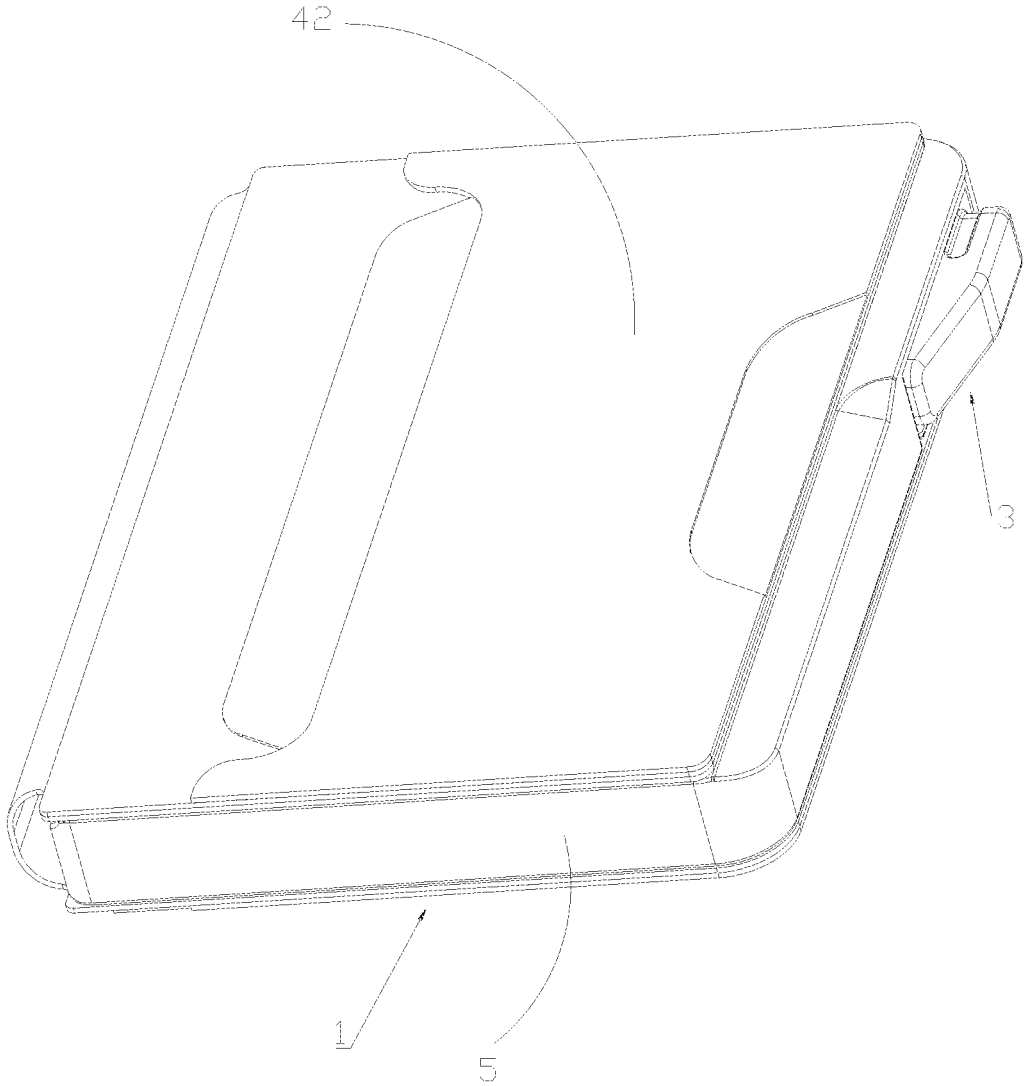
FIG. 2 is a schematic diagram of another entire structure of the present disclosure.
Figure 3:
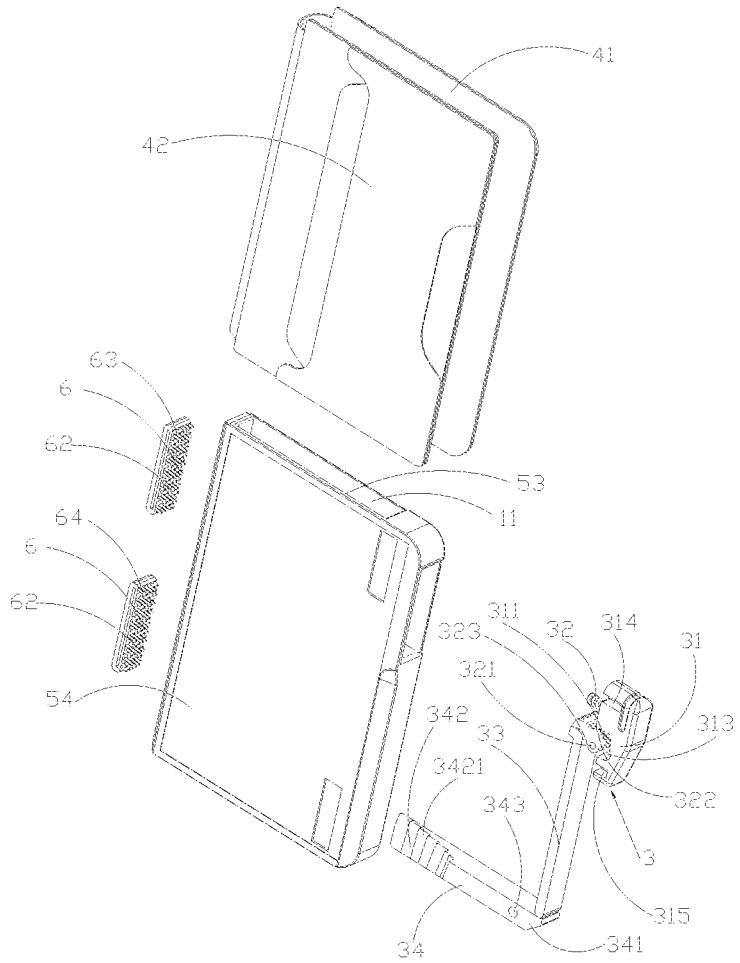
FIG. 3 is an exploded view of the present disclosure.
Figure 4:
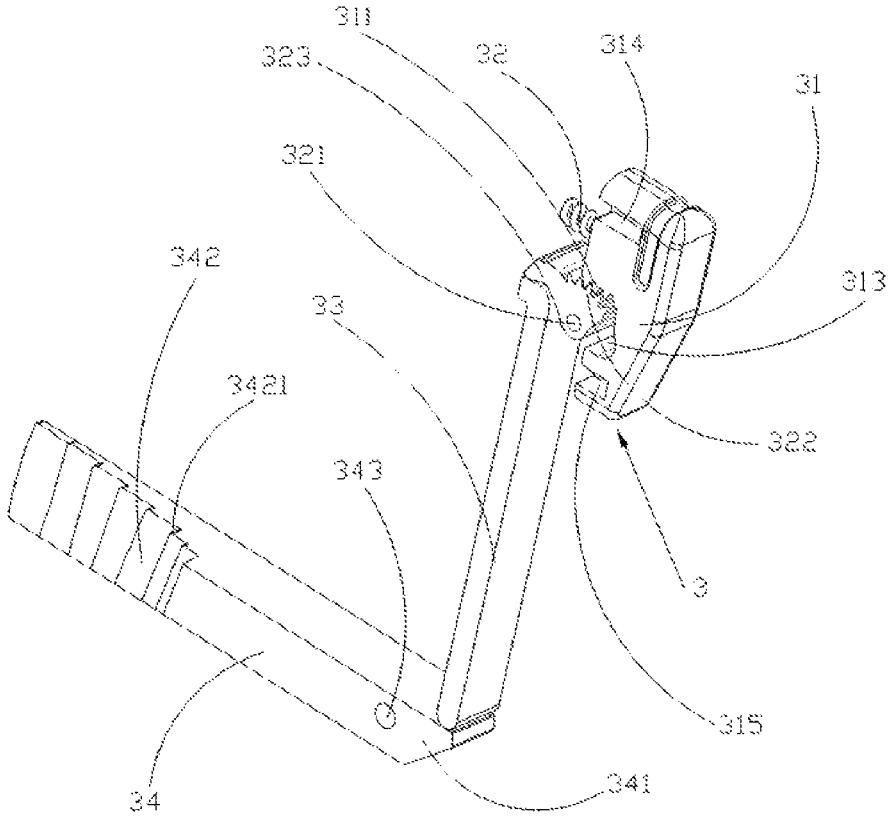
FIG. 4 is a schematic structural diagram of a push device.
Figure 5:
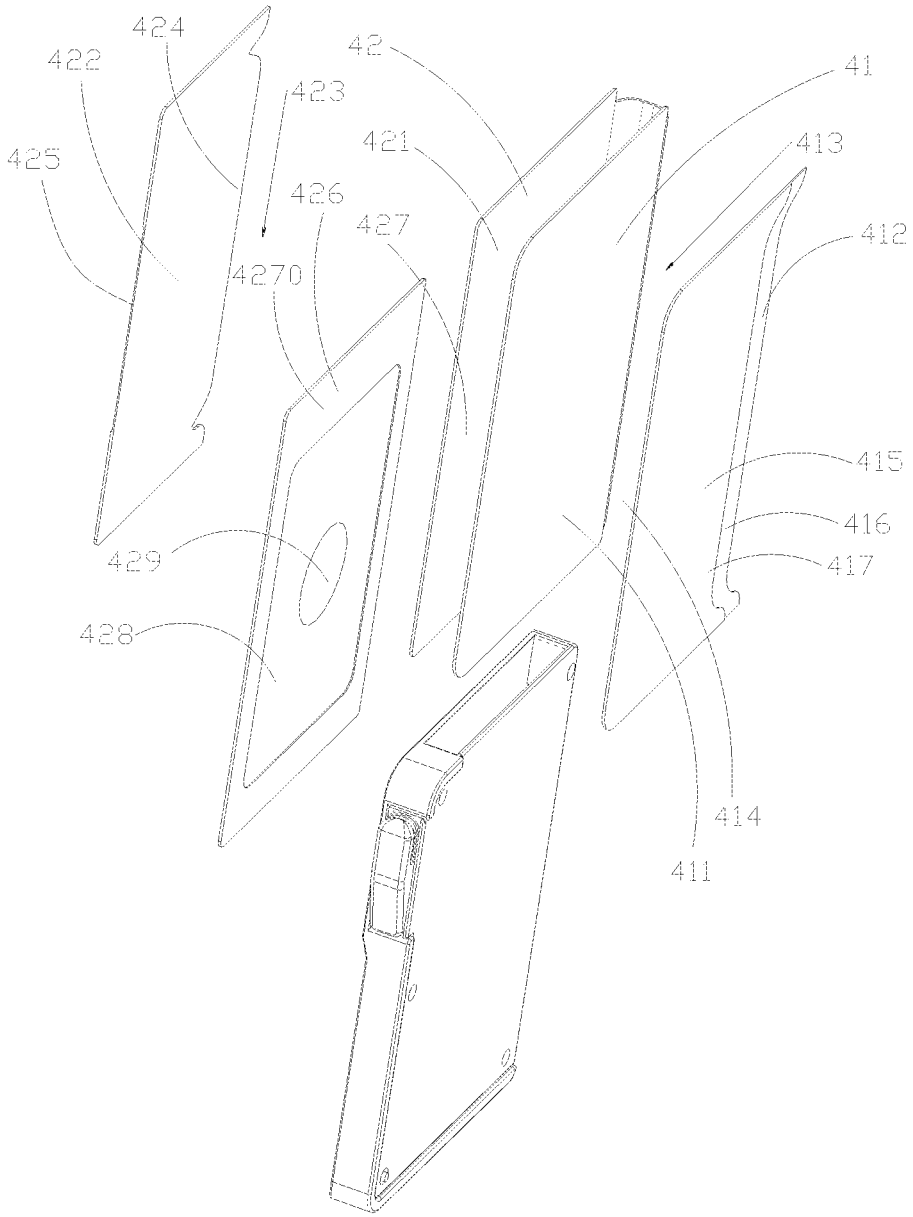
FIG. 5 is another exploded view of the present disclosure.
Figure 6:
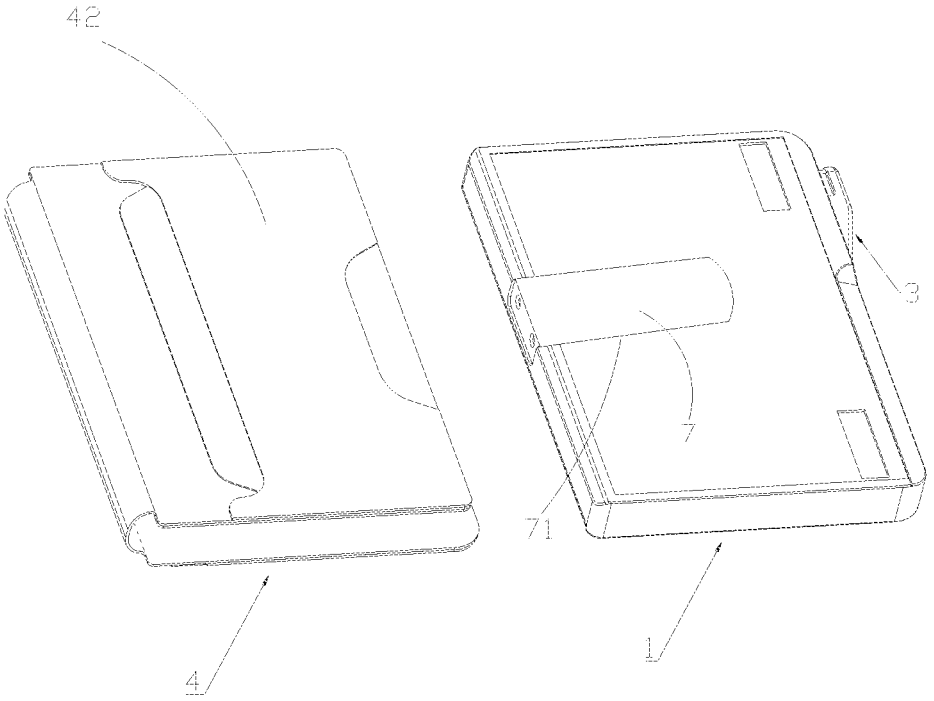
FIG. 6 is still another exploded view of the present disclosure.
Figure 7:
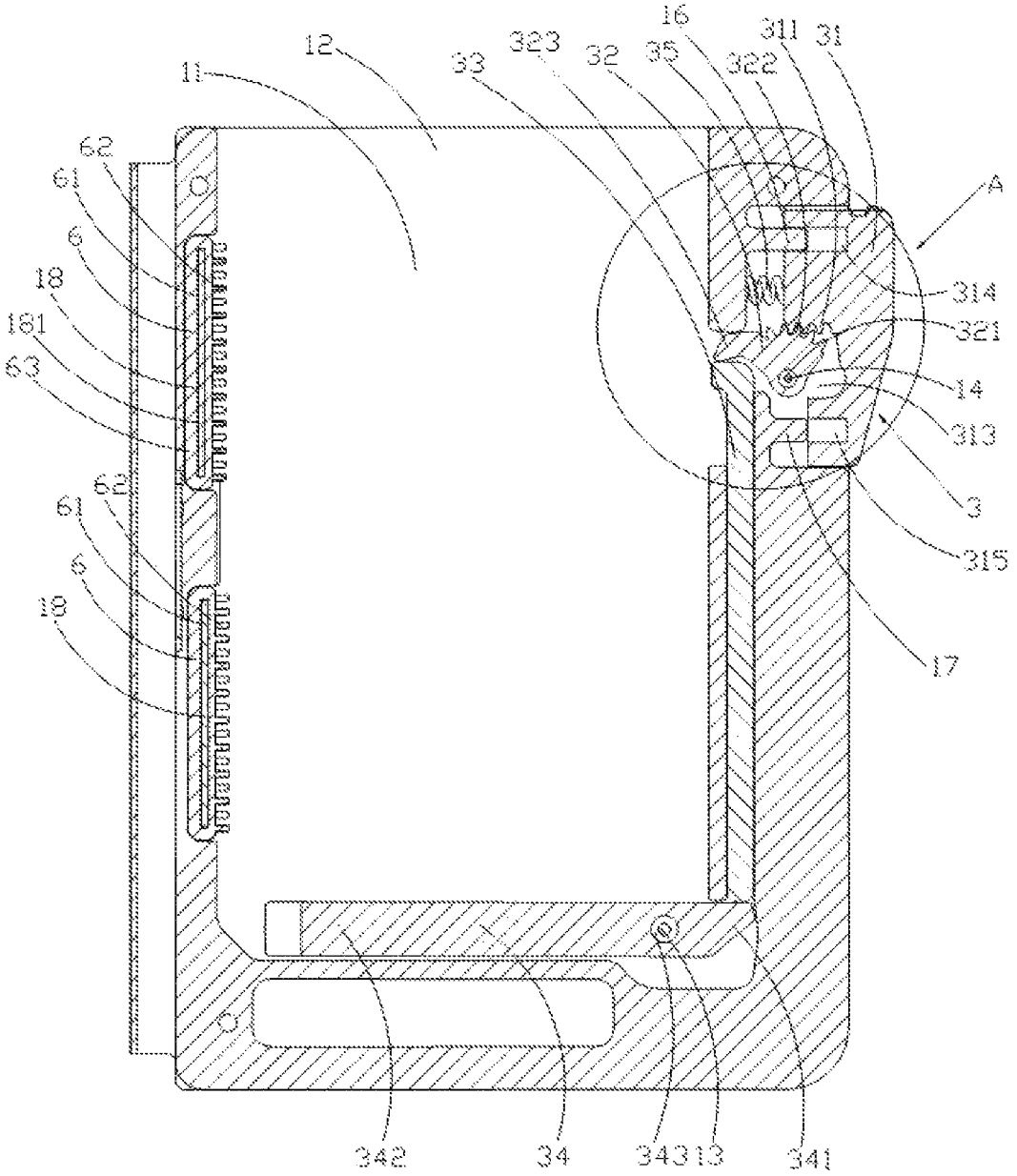
FIG. 7 is a sectional view cut away along a button, a push wheel, a push rod, and a push sheet.
Figure 8:
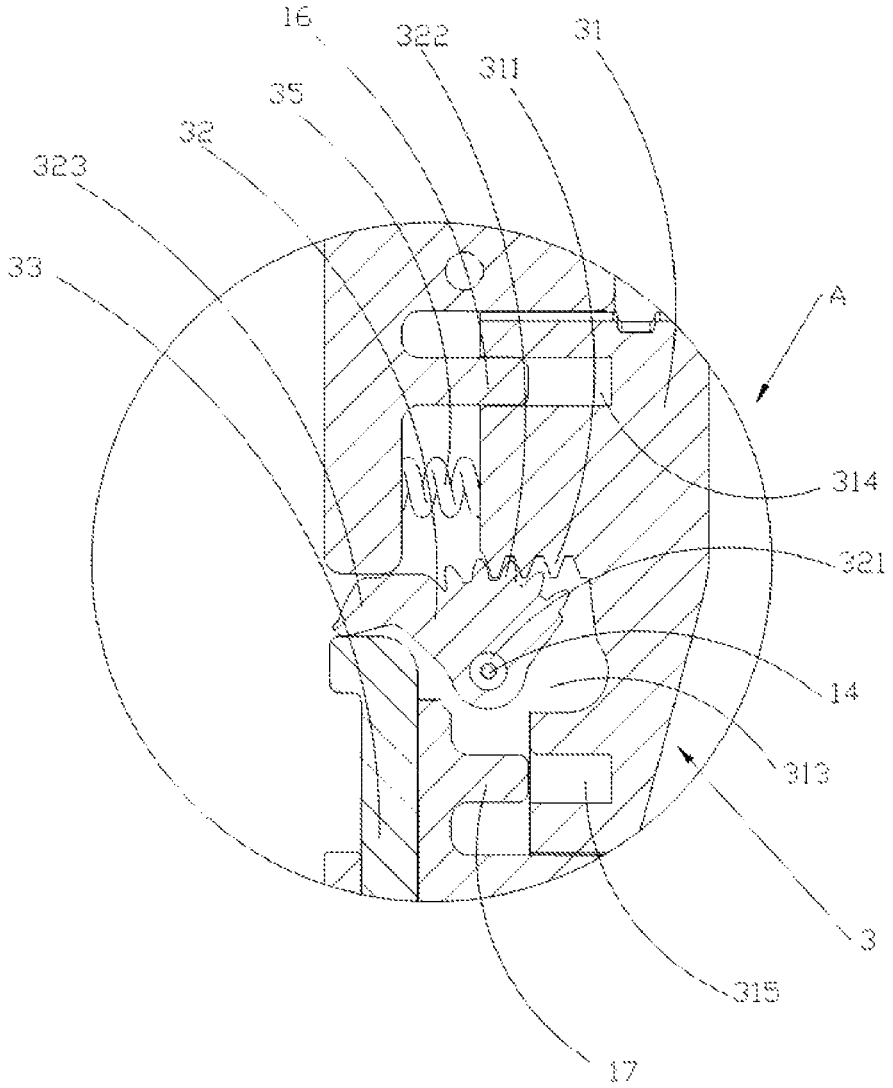
FIG. 8 is an enlarged view of the part A in FIG. 7.
Figure 9:
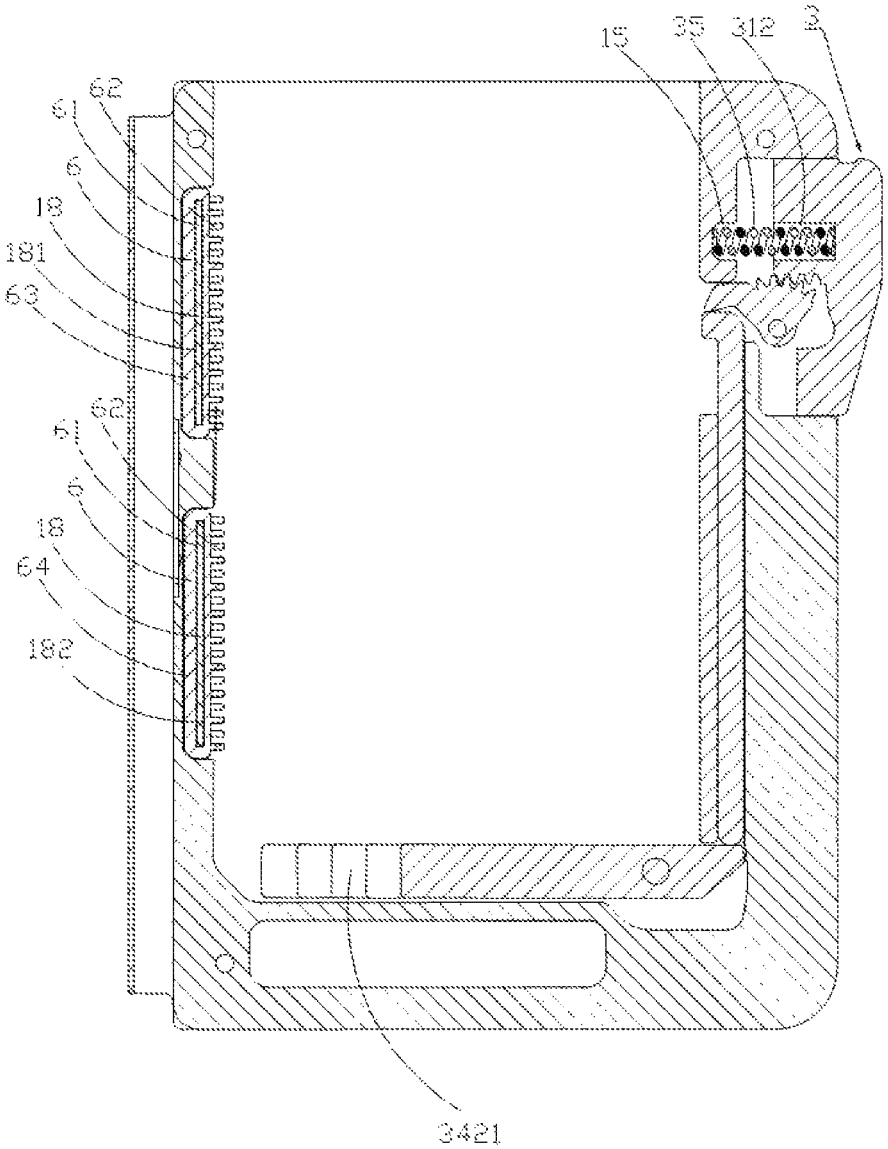
FIG. 9 is a sectional view cut away along an elastic reset member.

Referring to FIG. 1 to FIG. 9, a card holder wallet includes:

a shell 1, wherein the shell 1 is provided with a first accommodating cavity 11 and a first accommodating opening 12; the first accommodating cavity 11 is encircled by a side wall of the shell 1; the first accommodating opening 12 is communicated with the first accommodating cavity 11; the first accommodating cavity 11 is configured to accommodate a card; and a push device 3, wherein the push device 3 is connected to the shell 1; and the push device 3 is configured to push the card out of the first accommodating cavity 11 via the first accommodating opening 12.

Through the above structure, a user can easily push a card in the first accommodating cavity towards the first accommodating opening and out of the first accommodating cavity through the push device, making it easy for the user to accurately and quickly fetch a desired card.

In this embodiment, the push device 3 includes a button 31, a push wheel 32, a push rod 33, a push plate 34, and an elastic reset member 35; the shell 1 is provided with a first rotating shaft 13 and a second rotating shaft 14; the first rotating shaft 13 is arranged at a bottom of the first accommodating cavity 11; the push plate 34 has a first end 341 and a second end 342; a first mounting port 343 exists between the first end 341 and the second end 342; the first mounting port 343 of the push plate 34 sleeves the first rotating shaft 13; the push wheel 32 is provided with a second mounting port 321; the second mounting port 321 of the push wheel 32 sleeves the second rotating shaft 14; a push member is arranged between the push wheel 32 and the push plate 34; when the button 31 is pressed, the button 31 drives the push wheel 32 to rotate, and the push wheel 32 rotates to push the push rod 33 towards a direction facing away from the first accommodating opening 12, so that the push rod 33 pushes the first end 341 of the push plate 34 towards the direction facing away from the first accommodating opening 12 and pushes the second end 342 towards the first accommodating opening 12; the second end 342 pushes the card towards the first accommodating opening 12 and out of the first accommodating cavity 11; one end of the elastic reset member 35 is connected to the button 31, and the other end of the elastic reset member 35 is connected to the shell 1; when the button 31 is pressed, the elastic reset member 35 is compressed; and an elastic reset force provided when the elastic reset member 35 is compressed can push the button 31 to be reset. The second end 342 is provided with several steps 3421, and heights of the steps 3421 increase gradually in sequence from the second end 342 to the first end 341. Specifically, a quantity of the several steps 3421 is at least 2. Through the above structure, the user can press the button to drive the push wheel to rotate, and the push wheel rotates to drive the push rod to be pushed towards the direction facing away from the first accommodating opening, so that the second end pushes the card towards the first accommodating opening and out of the first accommodating cavity. Moreover, since the several steps are arranged on the second end, and the heights of the steps increase in sequence from the second end to the first end, the several steps with different heights can push cards at the various height positions in the first accommodating cavity, and positions of contact points between the steps with the different heights and the cards are not on the same axial line. Therefore, when the steps on the second end push the plurality of cards in the first accommodating cavity, the plurality of cards are pushed at different distances and are staggered, making it easier for the user to accurately and quickly fetch a desired card. Further, the elastic reset member can drive the button and the push wheel to be reset, but the push wheel will not drive the push rod and the push plate to be reset when it is reset, so that the card can be maintained at a position where it is pushed out of the first accommodating opening, facilitating the user to fetch the card. When the user has finished fetching the card, the remaining cards can be pushed into the first accommodating cavity in the direction facing away from the first accommodating opening to push the push plate and the push rod to be reset.

In this embodiment, the button 31 is provided with a rack 311; the push wheel 32 is provided with a gear 322 and a pressing convex block 323; the gear 322 is engaged with the rack 311; and when the button 31 is pressed, the rack 311 of the button 31 slides to drive the gear 322 of the push wheel 32 to rotate, and the pressing convex block 323 rotates with the gear 322 to push the push rod 33 in the direction facing away from the first accommodating opening 12. The button 31 is provided with a first mounting slot 312; the shell 1 is provided with a second mounting slot 15; and one end of the elastic reset member 35 is located in the second mounting slot 15, and the other end of the elastic reset member 35 is located in the first mounting slot 312. The button 31 is further provided with a third mounting slot 313; the rack 311 is arranged on an inner wall of the third mounting slot 313; and the gear 322 is located inside the third mounting slot 313. Further, the shell 1 is provided with a first sliding rail 16; and the button 31 can slide on the first sliding rail 16. Much further, the shell 1 is further provided with a second sliding rail 17; and the button 31 can slide on the second sliding rail 17. Much further, a first sliding chute 314 is arranged on an upper side of the button 31; a second sliding chute 315 is arranged on a lower side of the button 31; the first sliding chute 314 is connected to the first sliding rail 16; and the second sliding chute 315 is connected to the second sliding rail 17. Through the above structure, the mounting and arrangement of the button, the push wheel, the push rod, and the elastic reset member are effectively achieved. When the button 31 is pressed, the rack 311 of the button 31 slides to drive the gear 322 of the push wheel 32 to rotate, and the pressing convex block 323 rotates with the gear 322 to push the push rod 33 in the direction facing away from the first accommodating opening 12, so that the push rod pushes the first end of the push plate in the direction facing away from the first accommodating opening 12, and the second end of the push rod pushes the card towards the first accommodating opening and out of the first accommodating cavity. Moreover, since the first sliding chute 314 and the first sliding rail 16 are connected to each other, and the second sliding chute 315 and the second sliding rail 17 are connected to each other, the operation of the button can be more stable, so as to prevent misalignment, deviation, and jamming when the button is pressed and reset.

In this embodiment, the card holder wallet further includes a flexible protective sleeve 4; the protective sleeve 4 is provided with a first portion 41 and a second portion 42; the second portion 42 and the first portion 41 are rotatable; the first portion 41 is connected to a bottom surface of the shell 1; and the second portion 42 rotates to cover a top surface of the shell 1. In this embodiment, the first portion 41 includes a first sheet body 411 and a second sheet body 412; an inner side of the first sheet body 411 covers the bottom surface of the shell 1; the second sheet body 412 is connected to an outer side of the first sheet body 411; a second accommodating cavity 413 is formed between an inner side of the second sheet body 412 and the outer side of the first sheet body 411; and an upper side of the second accommodating cavity 413 is provided with a second accommodating opening 414. The first portion 41 includes a third sheet body 415; the third sheet body 415 is connected to the second sheet body 412; an inner side of the third sheet body 415 covers an outer side of the second sheet body 412; a third accommodating cavity 416 is formed between the inner side of the third sheet body 415 and the outer side of the second sheet body 412; an upper side of the third accommodating cavity 416 is provided with a third accommodating opening 417; both the second accommodating opening 414 and the third accommodating opening 417 are trapezoid accommodating openings; and the second accommodating opening 414 and the third accommodating opening 417 are arranged in sequence from top to bottom. Further, the second portion 42 includes a fourth sheet body 421 and a fifth sheet body 422; the fourth sheet body 421 is connected to the first sheet body 411; the fifth sheet body 422 is connected to an outer side of the fourth sheet body 421; an inner side of the fifth sheet body 422 covers the outer side of the fourth sheet body 421; a fourth accommodating cavity 423 is formed between the inner side of the fifth sheet body 422 and the outer side of the fourth sheet body 421; an upper side of the fourth accommodating cavity 423 is provided with a fourth accommodating opening 424; and a lower side of the fourth accommodating cavity 423 is provided with a first notch 425. Through the above structure, the user can also store cards through the second accommodating cavity, the third accommodating cavity, and the fourth accommodating cavity, which provides the user with more card storage spaces and facilitates the user to manage the cards. The first notch can also facilitate the user to push the card out of the fourth accommodating cavity.

Further, the second portion 42 further includes a sixth sheet body 426; the sixth sheet body 426 is connected to the inner side of the fourth sheet body 421; an inner side of the sixth sheet body 426 covers the inner side of the fourth sheet body 421; a fifth accommodating cavity 427 is formed between the inner side of the sixth sheet body 426 and the inner side of the fourth sheet body 421; the fifth accommodating cavity 427 is provided with a fifth accommodating opening 4270; the sixth sheet body 426 is provided with a transparent window 428; the transparent window 428 is provided with a second notch 429; and the second notch 429 is communicated with the fifth accommodating cavity 427. Through the above structure, the user can accommodate the card through the fifth accommodating cavity. As the sixth sheet body is provided with the transparent window, it is convenient for the user to observe the type of the card placed in the fifth accommodating cavity. Furthermore, the transparent window is provided with the second notch, so that when the user needs to take out the card, the user can put fingers into the second notch to push the card in the fifth accommodating cavity out of the fifth accommodating opening.

In this embodiment, the shell 1 further includes a first side wall 5 opposite to the first accommodating opening 12, a second side wall 51, a third side wall 52 opposite to the second side wall 51, a fourth side wall 53, and a fifth side wall 54 opposite to the fourth side wall 53; the first accommodating cavity 11 is encircled by the first side wall 5, the second side wall 51, the third side wall 52, the fourth side wall 53, and the fifth side wall 54; the card holder wallet further includes an elastic member 6; the elastic member 6 is arranged in the first accommodating cavity 11; the elastic member 6 is configured to press and lock the card in the first accommodating cavity 11; the elastic member 6 is arranged on an inner surface of the second side wall 51; and the elastic member 6 is configured to press and lock the card to the third side wall 52. The first portion 41 is connected to a bottom surface of the fourth side wall 53; and the second portion 42 rotates to cover a top surface of the fifth side wall 54. Specifically, the second portion 42 is provided with a magnetic suction member (not shown); the fifth side wall 54 is a magnetic metal side wall; and when the second portion 42 rotates to cover the top surface of the fifth side wall 54, the magnetic suction member sucks the second portion 42 to the top surface of the fifth side wall 54. Further, the button 31 is arranged on the third side wall 52. Through the above structure, the arrangement of the shell and the button is effectively achieved.

In this embodiment, an inner wall of the first accommodating cavity 11 is further provided with a locating piece 18, and the elastic member 6 is provided with a locating port 61. The locating port 61 sleeves the locating piece 18. The elastic member 6 is provided with several elastic bulges 62. The elastic bulges 62 press and lock the card into the first accommodating cavity 11. Specifically, the elastic member 6 is a silica gel elastic member 6. Further, the elastic member 6 includes a first elastic member unit 63 and a second elastic member unit 64; the locating piece 18 includes a first locating piece unit 181 arranged on an upper side of the inner wall of the first accommodating cavity 11 and a second locating piece unit 182 located on a lower side of the inner wall of the first accommodating cavity 11; the first elastic member unit 63 and the second elastic member unit 64 are independent of each other; the first elastic member unit 63 sleeves the first locating piece unit 181; and the second elastic member unit 64 sleeves the second locating piece unit 182. Through the above structure, when the card is put into the first accommodating cavity via the first accommodating opening, the elastic member arranged in the first accommodating cavity is pressed by two sides of the card. An elastic reset force generated when the elastic member is pressed compresses the card into the first accommodating cavity, which can effectively prevent the card from sliding out of the first accommodating cavity via the first accommodating opening, causing card loss. When the user needs to take out the card, the user only needs to press the button to enable the push plate to apply, to the card, a force greater than the elastic reset force generated when the elastic member is pressed, so as to take out the card from the first accommodating opening. Moreover, silica gel has better elastic performance, which can maintain elasticity for a long time. Compared to an ordinary spring and a clip, the silica gel elastic member has a longer service life and is softer. When the card is compressed into the first accommodating cavity, the card will not be damaged.

In this embodiment, the card holder wallet further includes a clamp 7. One end of the clamp 7 is connected to the shell 1, and the other end of the clamp 7 compresses the fifth side wall 54 to form a clamping space 71 between the clamp 7 and the fifth side wall 54. Through the above structure, the card holder wallet is simple in structure and stable in connection, and the mounting of the clamp is effectively achieved. A card or change can be put into the clamping space by pulling the clamp. Furthermore, the clamp can also be clamped onto a belt or a pocket through the clamping space.

As described above, one or more embodiments are provided in conjunction with the detailed description, The specific implementation of the present disclosure is not confirmed to be limited to that the description is similar to or similar to the method, the structure and the like of the present disclosure, or a plurality of technical deductions or substitutions are made on the premise of the conception of the present disclosure to be regarded as the protection of the present disclosure.

What is claimed is:

1. A card holder wallet, comprising:

a shell, wherein the shell is provided with a first accommodating cavity and a first accommodating opening; the first accommodating cavity is encircled by a side wall of the shell; the first accommodating opening is communicated with the first accommodating cavity; the first accommodating cavity is configured to accommodate a card; and a push device, wherein the push device is connected to the shell; and the push device is configured to push the card out of the first accommodating cavity via the first accommodating opening;

wherein the push device comprises a button, a push wheel, a push rod, a push plate, and an elastic reset member; the shell is provided with a first rotating shaft and a second rotating shaft; the first rotating shaft is arranged at a bottom of the first accommodating cavity: the push plate has a first end and a second end; a first mounting port exists between the first end and the second end; the first mounting port of the push plate sleeves the first rotating shaft; the push wheel is provided with a second mounting port; the second mounting port of the push wheel sleeves the second rotating shaft; a push member is arranged between the push wheel and the push plate; when the button is pressed, the button drives the push wheel to rotate, and the push wheel rotates to push the push rod towards a direction facing away from the first accommodating opening, so that the push rod pushes the first end of the push plate towards the direction facing away from the first accommodating opening and pushes the second end towards the first accommodating opening; the second end pushes the card towards the first accommodating opening and out of the first accommodating cavity; one end of the elastic reset member is connected to the button, and the other end of the elastic reset member is connected to the shell; when the button is pressed, the elastic reset member is compressed; and an elastic reset force provided when the elastic reset member is compressed pushes the button to be reset.

2. The card holder wallet according to claim 1, wherein the button is provided with a rack; the push wheel is provided with a gear and a pressing convex block; the gear is engaged with the rack; and when the button is pressed, the rack of the button slides to drive the gear of the push wheel to rotate, and the pressing convex block rotates with the gear to push the push rod in the direction facing away from the first accommodating opening.

3. The card holder wallet according to claim 1, wherein the button is provided with a first mounting slot; the shell is provided with a second mounting slot; and one end of the elastic reset member is located in the second mounting slot, and the other end of the elastic reset member is located in the first mounting slot.

4. The card holder wallet according to claim 3, wherein the button is further provided with a third mounting slot; the rack is arranged on an inner wall of the third mounting slot; and the gear is located inside the third mounting slot.

5. A card holder wallet, comprising:

a shell, wherein the shell is provided with a first accommodating cavity and a first accommodating opening; the first accommodating cavity is encircled by a side wall of the shell; the first accommodating opening is communicated with the first accommodating cavity; the first accommodating cavity is configured to accommodate a card;

a push device, wherein the push device is connected to the shell; and the push device is configured to push the card out of the first accommodating cavity via the first accommodating opening; and a flexible protective sleeve, wherein the protective sleeve is provided with a first portion and a second portion; the second portion is rotatably connected to the first portion; the first portion is connected to a bottom surface of the shell; and the second portion rotates to cover a top surface of the shell.

6. The card holder wallet according to claim 5, wherein the first portion comprises a first sheet body and a second sheet body; an inner side of the first sheet body covers the bottom surface of the shell; the second sheet body is connected to an outer side of the first sheet body; a second accommodating cavity is formed between an inner side of the second sheet body and the inner side of the first sheet body; and an upper side of the second accommodating cavity is provided with a second accommodating opening.

7. The card holder wallet according to claim 6, wherein the first portion comprises a third sheet body; the third sheet body is connected to the second sheet body; an inner side of the third sheet body covers an outer side of the second sheet body; a third accommodating cavity is formed between the inner side of the third sheet body and the outer side of the second sheet body; an upper side of the third accommodating cavity is provided with a third accommodating opening; both the second accommodating opening and the third accommodating opening are trapezoid accommodating openings; and the second accommodating opening and the third accommodating opening are arranged in sequence from top to bottom.

8. The card holder wallet according to claim 7, wherein the second portion comprises a fourth sheet body and a fifth sheet body; the fourth sheet body is connected to the first sheet body such that the second portion is rotatably connected to the first portion; the fifth sheet body is connected to an outer side of the fourth sheet body; an inner side of the fifth sheet body covers the outer side of the fourth sheet body; a fourth accommodating cavity is formed between the inner side of the fifth sheet body and the outer side of the fourth sheet body; an upper side of the fourth accommodating cavity is provided with a fourth accommodating opening; and a lower side of the fourth accommodating cavity is provided with a first notch.

9. The card holder wallet according to claim 8, wherein the second portion further comprises a sixth sheet body; the sixth sheet body is connected to the inner side of the fourth sheet body; the sixth sheet body covers the inner side of the fourth sheet body; a fifth accommodating cavity is formed between the sixth sheet body and the inner side of the fourth sheet body; the fifth accommodating cavity is provided with a fifth accommodating opening; the sixth sheet body is provided with a transparent window; the transparent window is provided with a second notch; and the second notch is communicated with the fifth accommodating cavity.

10. The card holder wallet according to claim 9, wherein the shell further comprises a first side wall opposite to the first accommodating opening, a second side wall, a third side wall opposite to the second side wall, a fourth side wall, and a fifth side wall opposite to the fourth side wall; the first accommodating cavity is encircled by the first side wall, the second side wall, the third side wall, the fourth side wall, and the fifth side wall; the card holder wallet further comprises an elastic member; the elastic member is arranged in the first accommodating cavity; the elastic member is configured to press and lock the card in the first accommodating cavity;

the elastic member is arranged on an inner surface of the second side wall; and the elastic member is configured to press and lock the card to the third side wall.

11. The card holder wallet according to claim 10, wherein the first portion is connected to a bottom surface of the fourth side wall; and the second portion rotates to cover a top surface of the fifth side wall.

12. The card holder wallet according to claim 1, wherein the shell is provided with a first sliding rail; and the button slides on the first sliding rail.

13. The card holder wallet according to claim 12, wherein the shell is further provided with a second sliding rail; and the button slides on the second sliding rail.

14. The card holder wallet according to claim 13, wherein a first sliding chute is arranged on an upper side of the button; a second sliding chute is arranged on a lower side of the button; the first sliding chute is connected to the first sliding rail; and the second sliding chute is connected to the second sliding rail.

15. The card holder wallet according to claim 10, wherein an inner wall of the first accommodating cavity is further provided with a locating piece, and the elastic member is provided with a locating port; and the locating port sleeves the locating piece.

16. The card holder wallet according to claim 15, wherein the elastic member is provided with several elastic bulges; the elastic bulges press and lock the card in the first accommodating cavity; the elastic member comprises a first elastic member unit and a second elastic member unit; the locating piece comprises a first locating piece unit arranged on an upper side of the inner wall of the first accommodating cavity and a second locating piece unit located on a lower side of the inner wall of the first accommodating cavity; the first elastic member unit and the second elastic member unit are independent of each other; the first elastic member unit sleeves the first locating piece unit; and the second elastic member unit sleeves the second locating piece unit.

17. The card holder wallet according to claim 10, further comprising an elastic clamp; one end of the clamp is connected to the shell, and the other end of the clamp compresses the fifth side wall to form a clamping space between the clamp and the fifth side wall.

18. The card holder wallet according to claim 1, wherein the second end is provided with several steps, and heights of the steps increase gradually in sequence from the second end to the first end.

* * * * *